US011149501B2

(12) United States Patent
Smith et al.

(10) Patent No.: US 11,149,501 B2
(45) Date of Patent: Oct. 19, 2021

(54) ROD COUPLER AND COUPLED ROD ASSEMBLY

(71) Applicant: Vermeer Manufacturing Company, Pella, IA (US)

(72) Inventors: Jacob Richard Smith, Altoona, IA (US); Michael David Langenfeld, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 35 days.

(21) Appl. No.: 16/816,664

(22) Filed: Mar. 12, 2020

(65) Prior Publication Data

US 2020/0291728 A1 Sep. 17, 2020

Related U.S. Application Data

(60) Provisional application No. 62/818,199, filed on Mar. 14, 2019.

(51) Int. Cl.
*E21B 17/046* (2006.01)

(52) U.S. Cl.
CPC ..... *E21B 17/046* (2013.01)

(58) Field of Classification Search
CPC ..... E21B 17/02; E21B 17/04; E21B 17/046; E21B 17/18
See application file for complete search history.

(56) References Cited

U.S. PATENT DOCUMENTS

| | | | |
|---|---|---|---|
| 1,274,254 | A | 7/1918 | Fleek |
| 2,760,358 | A | 8/1956 | Helm et al. |
| 3,142,972 | A | 8/1964 | Spaulding, Jr. |
| 3,260,541 | A | 7/1966 | Sadler et al. |
| 3,360,285 | A | 12/1967 | Huckshold |
| 3,940,946 | A | 3/1976 | Andersen |
| 4,378,057 | A | 3/1983 | O'Connell |
| 4,397,485 | A | 8/1983 | Wood |
| 4,622,022 | A | 11/1986 | Diffenderfer et al. |
| 4,732,223 | A | 3/1988 | Schoeffler et al. |

(Continued)

FOREIGN PATENT DOCUMENTS

| | | | |
|---|---|---|---|
| CN | 104499957 | A | 4/2015 |
| CN | 204729005 | U | 10/2015 |

(Continued)

OTHER PUBLICATIONS

International Search Report and Written Opinion for Application No. PCT/US2020/022284 dated Jun. 29, 2020 (15 pages).

(Continued)

*Primary Examiner* — David Carroll
(74) *Attorney, Agent, or Firm* — Michael Best and Friedrich LLP

(57) ABSTRACT

A coupler for a drill rod includes a body defining an inner bore extending along a longitudinal axis, at least a portion of the inner bore defining a non-circular profile having a plurality of flats including a first pair of adjacent flats defining a vertex therebetween. A cross aperture of the body has a central axis that is perpendicular to and offset from the longitudinal axis. A radially-innermost portion of the cross aperture extends perpendicular to a reference line extending from the longitudinal axis to the vertex.

26 Claims, 14 Drawing Sheets

(56) References Cited

U.S. PATENT DOCUMENTS

| | | | | |
|---|---|---|---|---|
| 4,772,246 | A | 9/1988 | Wenzel | |
| 4,824,418 | A | 4/1989 | Taubert | |
| 5,288,271 | A | 2/1994 | Nelson et al. | |
| 5,408,905 | A | 4/1995 | Mikic et al. | |
| 5,484,029 | A | 1/1996 | Eddison | |
| 5,490,569 | A | 2/1996 | Brotherton et al. | |
| 6,173,794 | B1 | 1/2001 | von Gynz-Rekowski et al. | |
| 6,494,495 | B1 | 12/2002 | Cunningham | |
| RE38,418 | E | 2/2004 | Deken et al. | |
| 7,469,524 | B2 | 12/2008 | Rieck et al. | |
| 7,624,819 | B1 | 12/2009 | LeBlanc et al. | |
| 7,694,753 | B2 | 4/2010 | Carlson et al. | |
| 7,770,659 | B2 | 8/2010 | Uelhoff et al. | |
| 8,062,140 | B2 | 11/2011 | Wall et al. | |
| 8,201,644 | B2 | 6/2012 | Hall et al. | |
| 8,322,460 | B2 | 12/2012 | Horton, III et al. | |
| 8,534,388 | B2 | 9/2013 | Hall et al. | |
| 8,650,992 | B2 | 2/2014 | Neitzell et al. | |
| 8,915,788 | B2 | 12/2014 | Foote et al. | |
| 9,366,087 | B2 | 6/2016 | Sugiura et al. | |
| 9,382,950 | B2 | 7/2016 | Pheasey et al. | |
| 9,556,691 | B2 | 1/2017 | Van Zee et al. | |
| 9,598,905 | B2 | 3/2017 | Van Zee et al. | |
| 9,890,880 | B2 | 2/2018 | Allin | |
| 10,364,611 | B2 | 7/2019 | Lubberger et al. | |
| 10,711,520 | B2 * | 7/2020 | Langenfeld | E21B 17/18 |
| 2004/0069517 | A1 | 4/2004 | Olson | |
| 2007/0054743 | A1 | 3/2007 | Pleyer | |
| 2007/0272444 | A1 | 11/2007 | Carlson et al. | |
| 2008/0083077 | A1 | 4/2008 | Alexander et al. | |
| 2009/0298597 | A1 | 12/2009 | Wall et al. | |
| 2010/0044113 | A1 | 2/2010 | LeBlanc et al. | |
| 2011/0215568 | A1 * | 9/2011 | Webb | E21B 17/046 285/330 |
| 2012/0141194 | A1 | 6/2012 | Rutledge, Sr. et al. | |
| 2013/0207381 | A1 | 8/2013 | Morrison et al. | |
| 2014/0027184 | A1 | 1/2014 | Slaughter, Jr. et al. | |
| 2014/0196955 | A1 * | 7/2014 | Queen | E21B 7/005 175/57 |
| 2014/0224545 | A1 | 8/2014 | Nicol-Seto | |
| 2014/0305709 | A1 | 10/2014 | Slaughter, Jr. et al. | |
| 2014/0353045 | A1 * | 12/2014 | Zhang | E21B 17/046 175/320 |
| 2015/0167399 | A1 | 6/2015 | Kuhn et al. | |
| 2015/0197995 | A1 | 7/2015 | Gil et al. | |
| 2015/0233192 | A1 | 8/2015 | Slaughter, Jr. et al. | |
| 2016/0245025 | A1 | 8/2016 | Slaughter, Jr. et al. | |
| 2018/0313171 | A1 * | 11/2018 | Vos | E21B 19/16 |

FOREIGN PATENT DOCUMENTS

| | | | |
|---|---|---|---|
| CN | 204754796 | U | 11/2015 |
| CN | 105863511 | A | 8/2016 |
| DE | 1909931 | A1 | 9/1969 |
| DE | 19527990 | C1 | 8/1996 |
| DE | 19906687 | A1 | 8/2000 |
| EP | 0190669 | A2 | 8/1986 |
| EP | 0851090 | A1 | 7/1998 |
| EP | 2157277 | A1 | 2/2010 |
| EP | 2505762 | A2 | 10/2012 |
| EP | 3399134 | A1 | 11/2018 |
| GB | 1030984 | A | 5/1966 |
| GB | 2492695 | B | 11/2017 |
| WO | 9630616 | A1 | 10/1996 |
| WO | 1999064712 | A1 | 12/1999 |
| WO | 2010021999 | A2 | 2/2010 |
| WO | 2011146490 | A1 | 11/2011 |
| WO | 2013159153 | A1 | 10/2013 |
| WO | 2013173785 | A1 | 11/2013 |
| WO | 2016043719 | A1 | 3/2016 |
| WO | 2016149183 | A1 | 9/2016 |
| WO | 2017135929 | A1 | 8/2017 |

OTHER PUBLICATIONS

European Patent Office Search Report for Application No. 18170061.8 dated Feb. 21, 2018 (8 pages).

Upstream Pumping, "Directional Drilling Motors Evolve for Demanding Downhole Environments", May/Jun. 2015, <http://www.upstreampumping.com/article/drilling/2015/directional-drilling-motors>, (6 pages).

Bahco, "Screwdriver Catalogue", ERGO Screwdrivers, Hexagonal, Hex Ball Double Handle, 2016, cover, pp. 20-21.

Terra Trenchless Technologies, "HDD Horizontal Directional Drilling" Product List, Rod Connectors (Drive Chucks), Sub Savers, Drill Rod Connector 170/API-36pin (MJLV), Mar. 22, 2017 (1 page).

ChinA-ogpe.com, Product Directory, Oil Field Tool, Other Oil Field Tools, taper drill rod (flr032), Mar. 3, 2017 (2 pages).

Zen Cart The Art of E-Commerce, "Rineer M057 Hydraulic Rotary Heard" Product Information, Mar. 22, 2017 (3 pages).

CMW, "JT4020 Mach 1/All Terrain" Operators Manual, Issue 5.1, 2011, pp. Service—202, 210, 221 (229 pages).

* cited by examiner

ROD COUPLER AND COUPLED ROD ASSEMBLY

RELATED APPLICATIONS

This application claims the benefit of U.S. Provisional Patent Application No. 62/818,199 filed Mar. 14, 2019, the entire content of which is hereby incorporated herein by reference.

BACKGROUND

The present invention relates to the coupling together of rods in a torque transmitting relation. The present invention further relates to an assembly of coupled rods, which in some embodiments, can be used in horizontal directional drilling systems.

Dual drill rod drilling systems for use in directional drilling, and having an inner rod and an outer rod, are known. A typical dual rod drilling system is generally configured to drive into the ground a series of drill rods joined end-to-end to form a drill string. At the end of the drill string is a rotating drilling tool or drill bit. A dual rod drilling system typically includes a first drive mechanism that controls rotation of a drill bit and a second drive mechanism that controls rotation of a steering element.

SUMMARY

The present invention addresses how to retain a coupler on an inner rod of a dual rod drill rod assembly. In such inner rod designs, it is important to maximize the flow path for drilling fluid travelling in the annular space between the inner and outer rods. As such, the design of the coupler must contemplate both the rod retention feature, which largely impacts the internal features of the coupler, the flow maximization feature, which largely impacts the external features of the coupler, and the interplay between these two features. Care must be given to achieve adequate strength and fatigue life for transmission of torque and longitudinal forces, while still ensuring adequate fluid flow.

In one aspect, the invention provides a coupler for a drill rod. The coupler includes a body defining an inner bore extending along a longitudinal axis, at least a portion of the inner bore defining a non-circular profile having a plurality of flats including a first pair of adjacent flats defining a vertex therebetween. A cross aperture of the body has a central axis that is perpendicular to and offset from the longitudinal axis. A radially-innermost portion of the cross aperture extends perpendicular to a reference line extending from the longitudinal axis to the vertex.

In another aspect, the invention provides a coupler for a drill rod. The coupler includes a body defining an inner bore and a cross aperture. The inner bore extends along a longitudinal axis, at least a portion of the inner bore defining a non-circular profile. The cross aperture has a central axis that is perpendicular to and offset from the longitudinal axis. The body defines an outer peripheral surface, and at the axial position of the cross aperture, the outer peripheral surface is non-circular and includes a lobe through which the cross aperture is formed.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
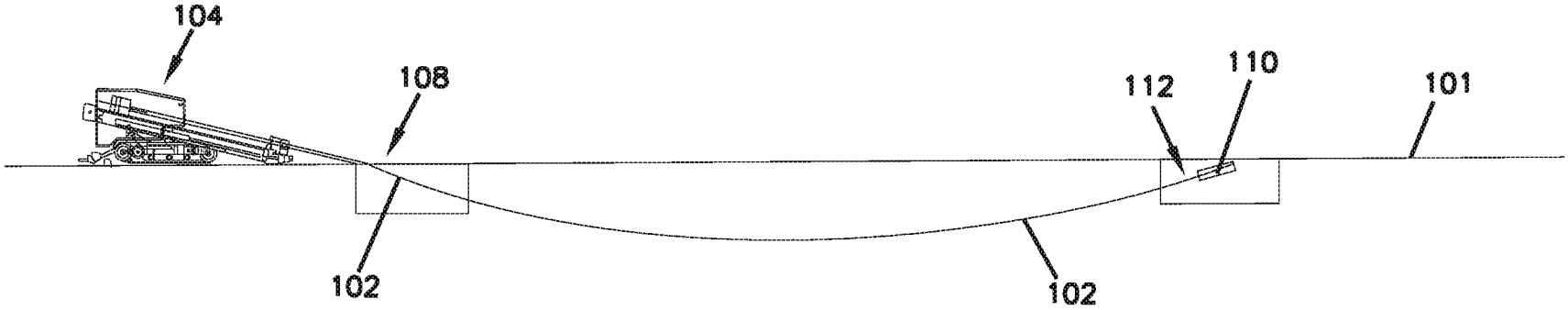
FIG. 1 illustrates a schematic side view of a drilling machine and a drill string, according to one embodiment of the present disclosure.

FIGS. 1-4 show a dual rod drilling system 100. The dual rod drilling system 100 includes a drill string 102 that is directed into the ground 101 by a drilling machine 104. An example drill string 102 is shown in FIG. 1.

The drilling machine 104 includes a prime mover 122 (e.g., a diesel engine), gearbox 124, a rack 126, and a break out mechanism 128 (e.g., a vise system). Optionally, the drilling machine 104 can include a drill rod storage box 130, an operator's station 132, and a set of tracks or wheels 134.

The drill string 102 consists of individual sections of drill rod assemblies 106 that are connected to the drilling machine 104 at an uphole end 108 and a drill head 110 at a downhole end 112. Each drill rod assembly 106 (FIG. 4) includes a downhole end 109 and an uphole end 111. The drill rod assemblies 106 are strung together end-to-end to form the drill string 102, which can extend significant distances in some drilling applications.

Each drill rod assembly 106 includes an outer tubular drill rod 114 having external threads on one end and internal threads on the opposite end. In some examples, the drill rod assembly 106, and the associated drilling machine 100, is configured so that, when the drill string 102 is constructed, the external threads of the outer drill rod 114 are positioned at the uphole end 111 of the drill rod assembly 106 and the internal threads of the outer drill rod 114 are positioned at the downhole end 109 of the drill rod assembly 106.

Figure 2:
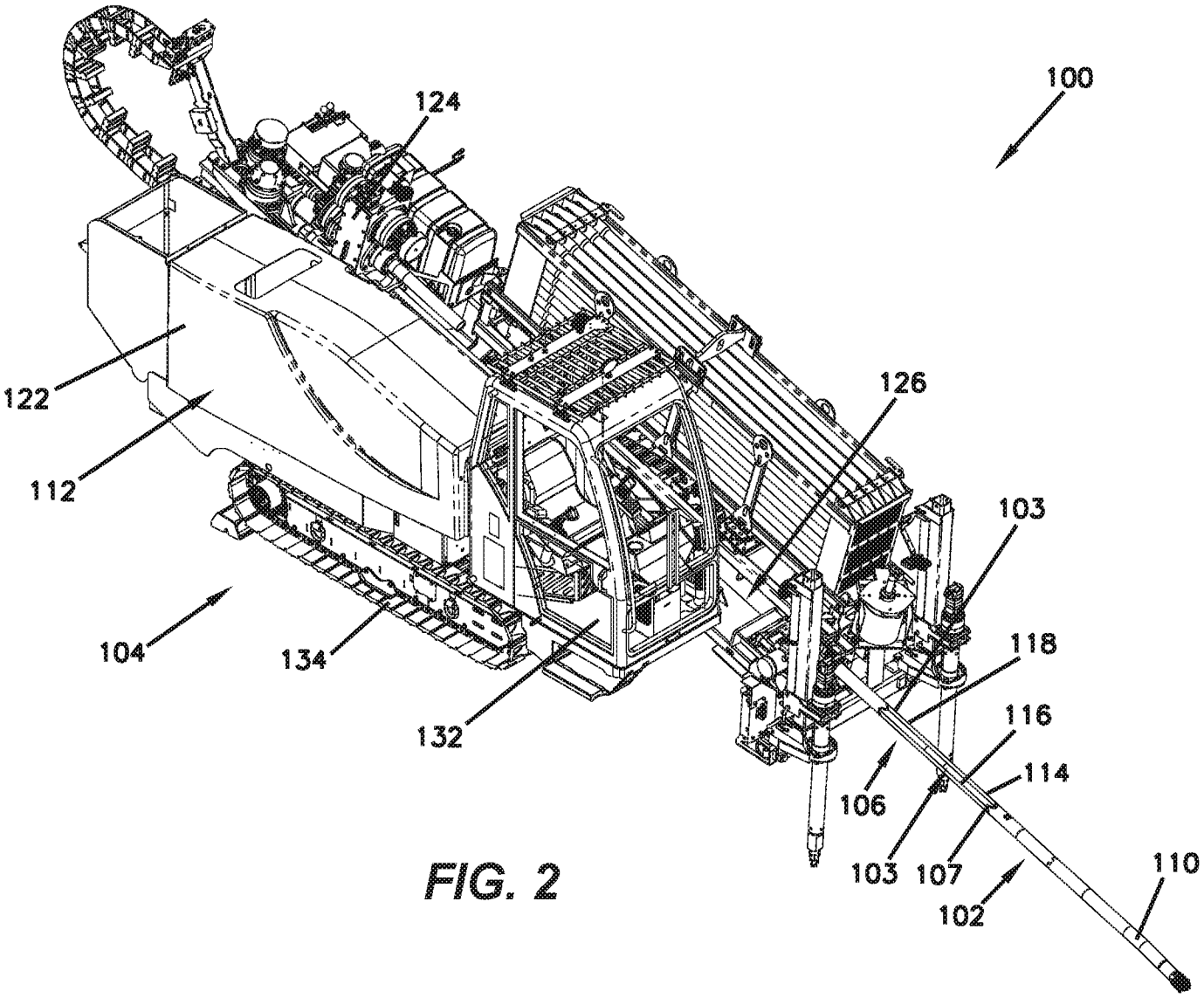
FIG. 2 illustrates a perspective view of a drilling machine, according to one embodiment of the present disclosure.
Figure 3:
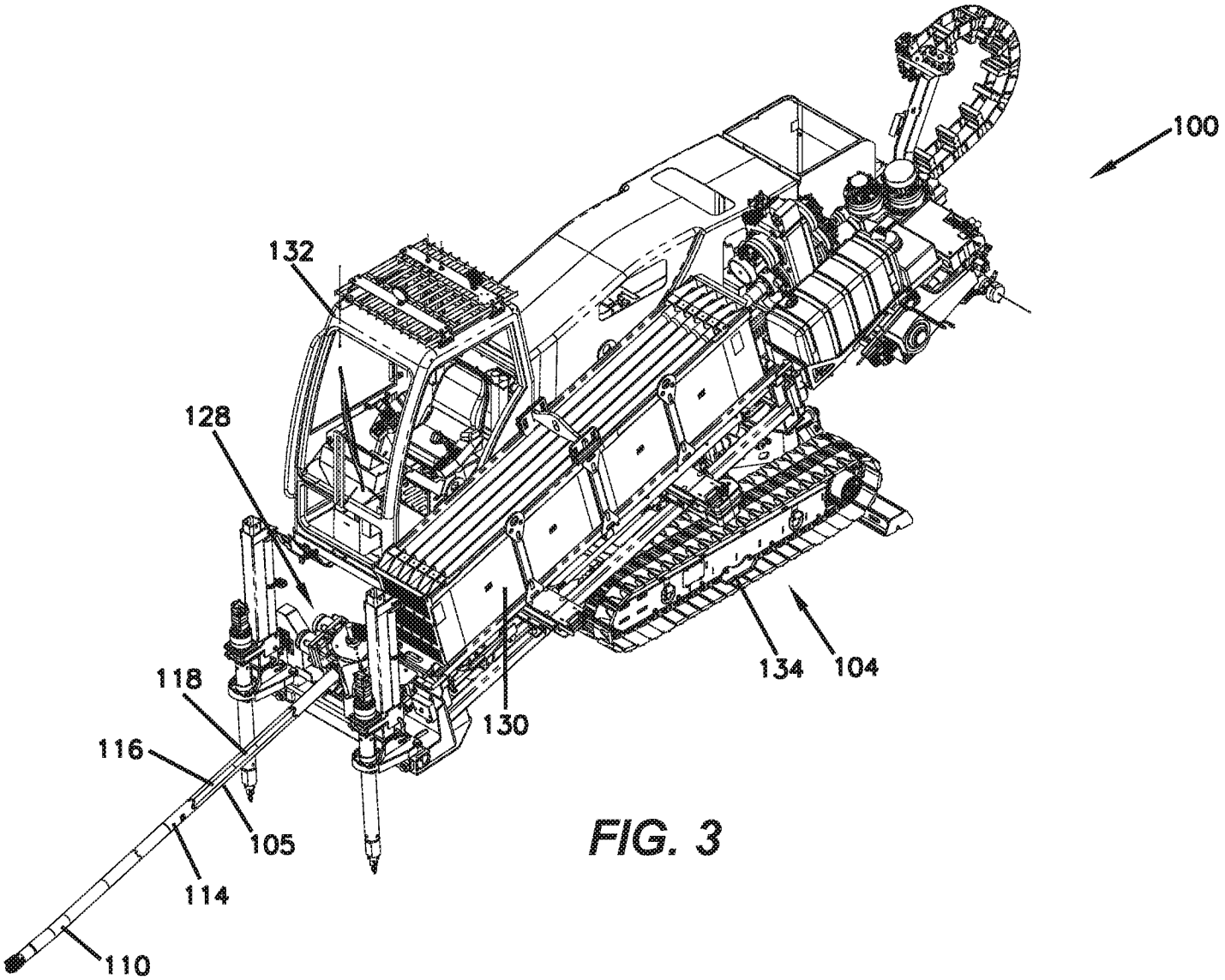
FIG. 3 illustrates another perspective view of the drilling machine of FIG. 2.
Figure 4:
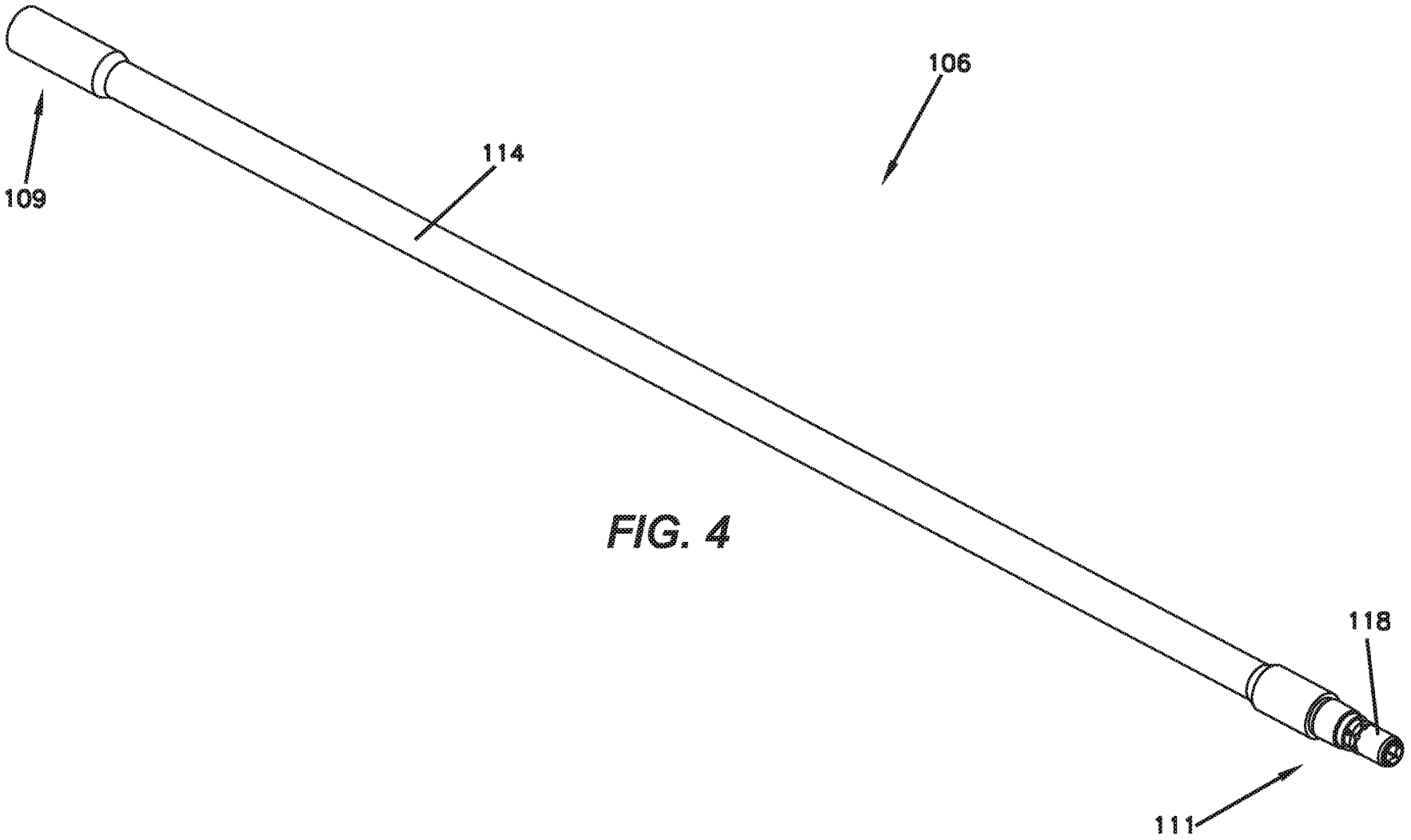
FIG. 4 illustrates a perspective view of a drilling rod assembly, according to one embodiment of the present disclosure.

Each drill rod assembly 106 further includes a smaller, inner drill rod 116 as illustrated in the cutaways of FIGS. 2 and 3. The inner drill rod 116 fits inside the tubular outer drill rod 114. The inner drill rod 116 of each drill rod assembly is interconnected to the adjacent inner drill rods by an inner rod coupling 118. In some examples, each inner rod coupling 118 is affixed to each inner drill rod 116 at the uphole end 111 of each drill rod assembly 106.

During a drilling operation, the drilling machine 104 individually removes drill rod assemblies 106 from the drill rod storage box 130 and moves each drill rod assembly 106 onto the rack 126. Once positioned on the rack 126, both the break out mechanism 128 and the gearbox 124 engage the drill rod assembly 106 and couple the drill rod assembly with an immediately preceding downhole drill rod assembly 106. Once coupled, the gearbox 124 is configured to travel longitudinally on the rack 126 toward the break out mechanism 128, while simultaneously rotating one or both of the outer and inner drill rods 114, 116 of the drill rod assembly 106. When the gearbox 124 reaches the break out mechanism 128 at the end of the rack 126, the gearbox 124 is de-coupled from the drill rod assembly 106, and thereby the drill string 102, and retracts up the rack 126 so that another drill rod assembly 106 can be added to the drill string 102. This process is repeated until the drilling operation is complete, and then reversed during a pullback operation in which the drilling machine 104 removes the drill rod assemblies 106 from the ground 101.

Figure 5:
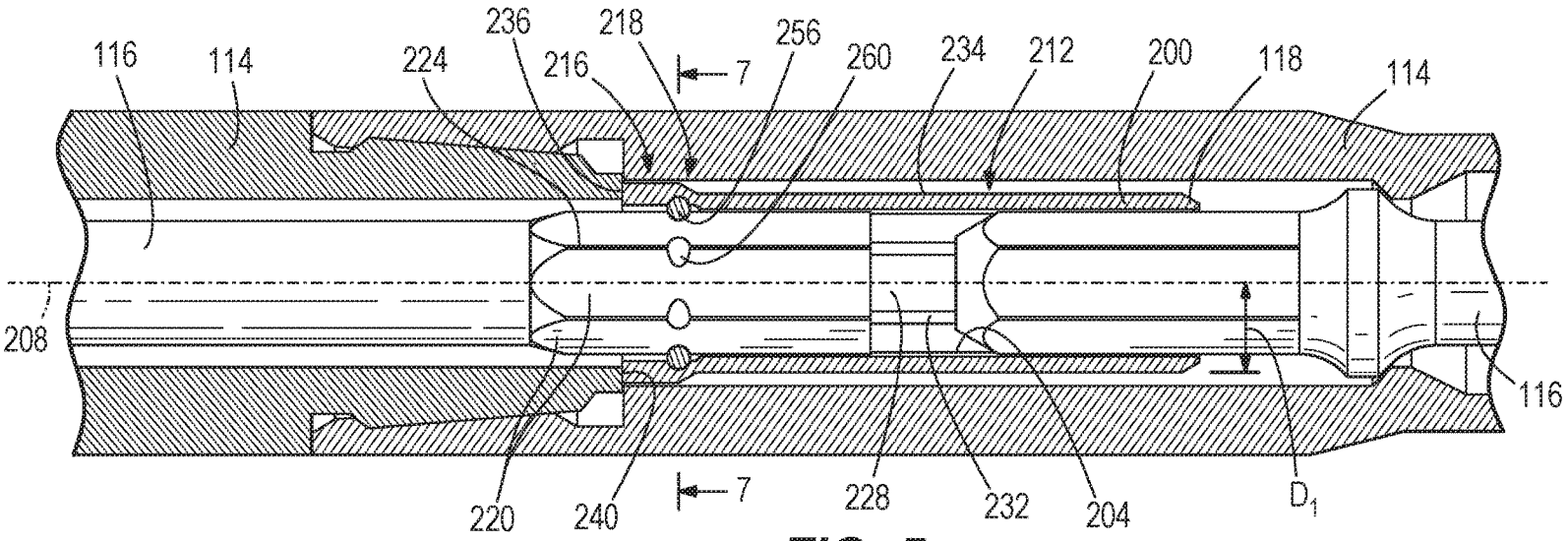
FIG. 5 illustrates a side, partial cross-sectional view of a coupled pair of drilling rod assemblies of FIG. 4.
Figure 6:
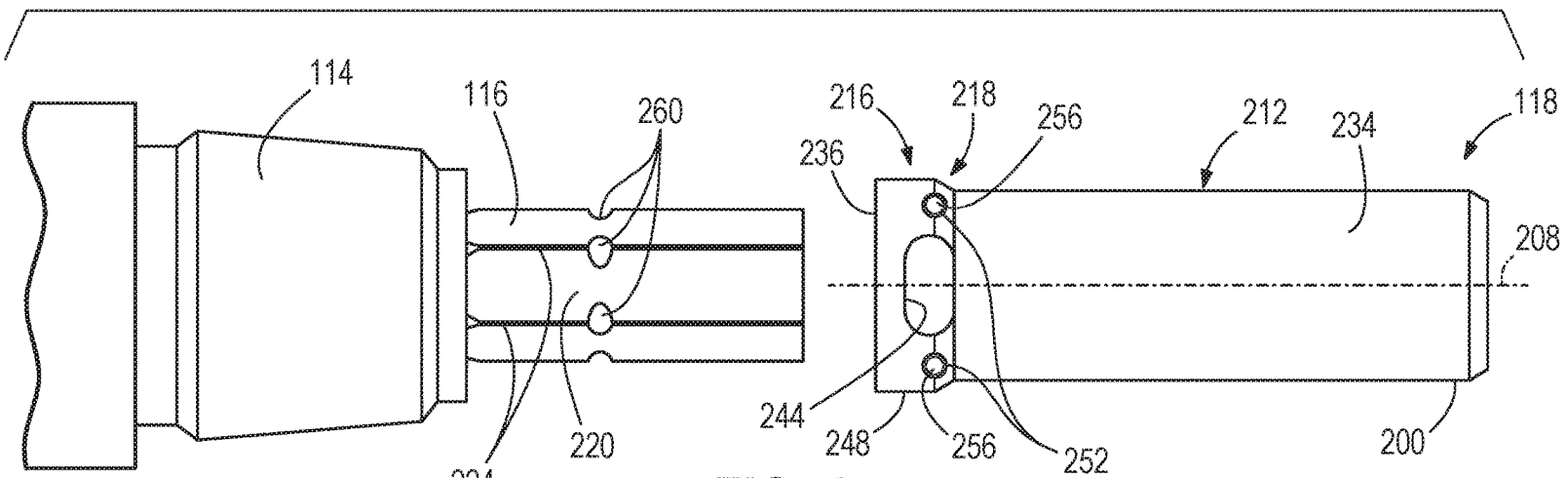
FIG. 6 illustrates a side view of the coupler removed from the inner rod.
Figure 7:
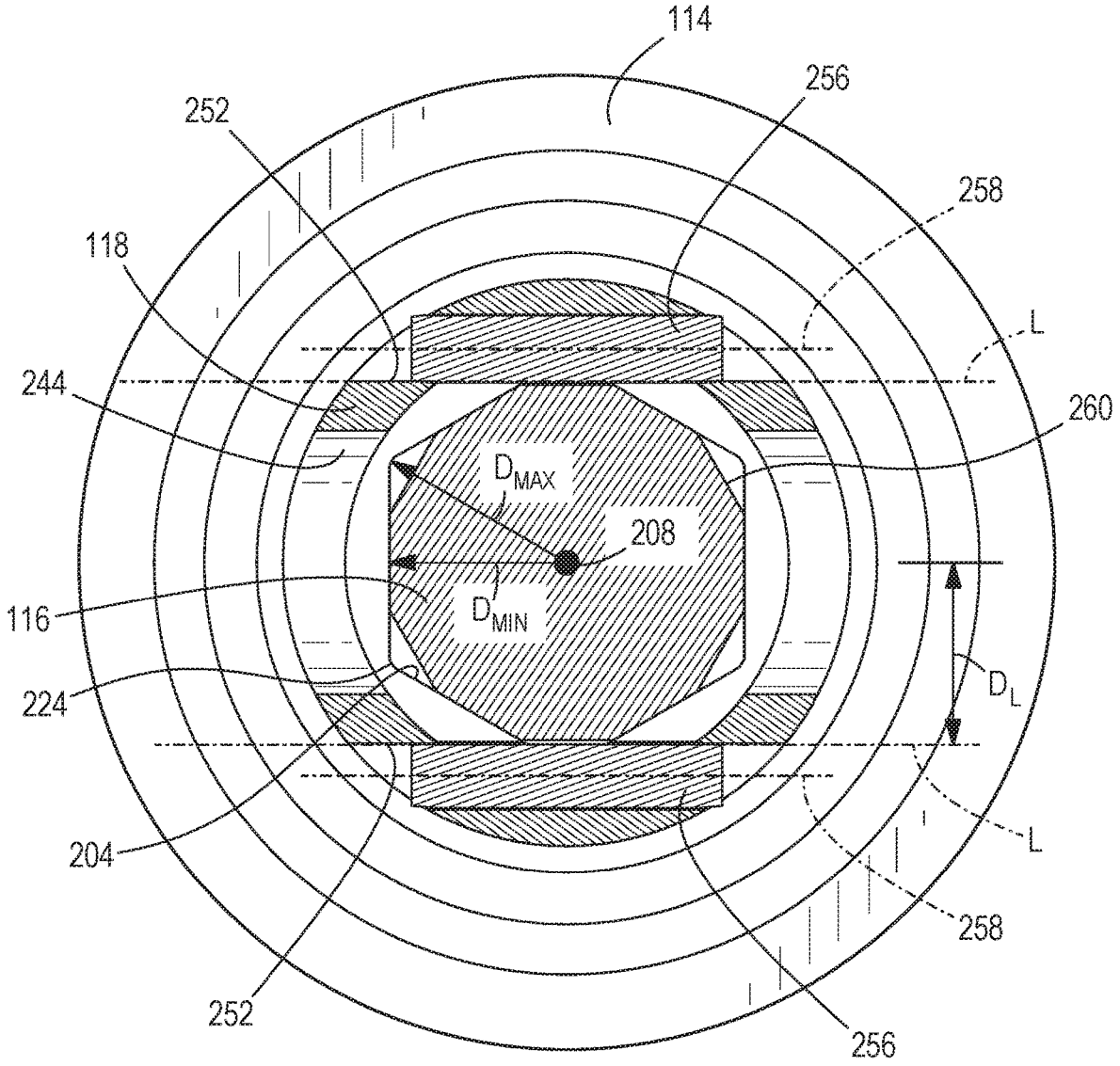
FIG. 7 is a section view illustrating the engagement between the retention pins in the coupler and the notches in the inner rod.

FIG. 5 is a section view illustrating two drill rod assemblies 106 coupled together, while FIG. 6 illustrates the coupler 118 removed from the inner rod 116. FIG. 7 is a section view of FIG. 5 taken through the retention pins 256. In the embodiment shown in FIGS. 5-7, the coupler 118 includes a body 200 made of a suitable metal material (e.g., steel) for coupling together two adjacent solid inner rods 116 in a manner that permits torque transfer between the two inner rods 116. The body 200 defines an inner bore 204 that, in the illustrated embodiment, extends the entire length of the coupler 118. The bore 204 defines a longitudinal axis 208 extending in a longitudinal or axial direction of the coupler 118. While the illustrated embodiment shows a solid inner rod 116, and while the features of the present invention are well-suited for use with drill rod assemblies having solid inner rods, it should be understood that the invention can also be practiced with drill rod assemblies having hollow inner rods.

The body 200 includes a first or main portion 212, and a second or enlarged portion 216 that is spaced longitudinally from the main portion 212. The main portion 212 forms a first axial region of the body 200, and the enlarged portion 216 forms a second axial region of the body 200 adjacent the first axial region. A small transition portion 218 can be provided between the main portion 212 and the enlarged portion 216, however, the transition portion 218 can be considered as being part of the enlarged portion 216. In this embodiment, the inner profile of the bore 204 is different in the main portion 212 than it is in the enlarged portion 216. More specifically, the inner bore 204 at the main portion 212 has a non-circular profile configured to mate with the non-circular profile at the ends of the inner rods 116 so as to fit on the adjacent inner rods 116 in torque-transferring relation. The illustrated non-circular profiles are hexagonal in shape (see also FIG. 8), but other non-circular shapes can also be used. The non-circular profile can be made up of a plurality of distributed flat sides and may be in the form of a polygon, and particularly a regular polygonal profile such as pentagonal (see FIG. 17), heptagonal (see FIG. 18), octagonal, square, and the like. Adjacent ones of the flat sides adjoin at vertices, and it should be understood that the vertices may be locally rounded off so that the true geometric vertices formed between the flat sides do not lie on the surface defining the non-circular profile. With respect to the rods 116, the hexagonal profile includes adjacent outer surface portions or flats 220 that intersect at respective edges or corners 224. With respect to the non-circular bore 204 inner profile, the hexagonal profile includes adjacent inner surface portions or flats 228 that intersect at respective internal vertices 232. With a simple polygonal shape, the vertices 232 are points that lie on the surface of the bore 204. However, it is conceived that the vertices 232 may be theoretical points of intersection not lying on the surface of the bore 204 (e.g., due to edge rounding from manufacturing). The illustrated main portion 212 can be made by broaching the non-circular profile into the bore of tube stock. The outer peripheral surface 234 of the main portion 212 is illustrated as being cylindrical, and, is without interruption. This facilitates the flow of drilling fluid between the outer peripheral surface 234 of the main portion 212 and the inner surface of the outer rod 114.

The inner bore 204 at the illustrated enlarged portion 216 is shown as having a circular/cylindrical profile with a diameter large enough so as not to engage with or otherwise interfere with the non-circular outer profile of the rod 116 to which the coupler 118 is secured. As such, the enlarged portion 216 is considered to be a non-torque-transferring portion of the coupler 118. As shown in FIG. 5, a distal end 236 of the enlarged portion 216 abuts and engages the distal end 240 of the outer rod 114. In order to permit and facilitate the flow of drilling fluid between the inner and outer rods 116, 114, one or more fluid flow openings 244 (see FIG. 6) are formed in the enlarged portion 216. In the illustrated embodiment, two diametrically-opposed slots 244 are formed in the enlarged portion 216 to provide communication between the inner bore 204 and the outer peripheral surface 248 of the enlarged portion 216. The outer peripheral surface 248 of the enlarged portion 216 is generally cylindrical, except that it is interrupted by the presence of the fluid flow openings 244.

The outer peripheral surface 248 of the enlarged portion 216 is also interrupted by the presence of one or more cross apertures 252 formed in the enlarged portion 216. The cross apertures 252 are configured to receive respective retention pins 256 that operate to secure the coupler 118 axially or longitudinally with respect to one of the inner rods 116 being coupled. This ensures that the coupler 118 will not separate from the inner rod 116 before or after the coupling procedure with the adjacent inner rod 116. While the illustrated embodiment utilizes two cross apertures 252 to respectively retain two pins 256, other embodiments may use only a single aperture 252 and a single pin 256.

The cross apertures 252 can be considered "cross" because they provide a passageway through the coupler 118 that crosses or traverses a portion of the inner bore 204. The cross apertures 252 each include a respective central axis 258 that is perpendicular to and offset from the longitudinal axis 208. The axes 258 of the two illustrated cross apertures 252 are parallel and spaced equidistant from the longitudinal axis 208. As best shown in FIG. 7, each cross aperture 252 provides a passageway for a pin 256, such that with the pin 256 installed in the cross aperture 252, the pin 256 at least partially extends into and passes through the inner bore 204. It can be seen that the cross apertures 252 are spaced apart from the longitudinal axis 208 (e.g., oppositely) by a distance such that only a portion of each of the pins 256 passes through, or intersects with, the inner bore 204. Meanwhile, another portion at the same circumferential position lies radially outside the inner bore 204. This relationship will be discussed further below. With this configuration, the pins 256 interfere with only an outer-most portion of the non-circular outer profile of the inner rod 116. To accommodate the pins 256, and to enable the pins 256 to axially retain the coupler 118 relative to the rod 116, the rod 116 includes a plurality of notches 260 formed in the non-circular outer profile of the inner rod 116. As shown in FIGS. 5-7, the notches 260 are formed by removing material from each of the edges or corners 224 at one axial location along the rod 116. Each notch 260 has a truncated cylindrical cross-sectional shape approximating the outer profile of the retention pins 256 to partially receive the same, although other cross-sectional shapes are optional. Each notch 260 extends perpendicular to the longitudinal axis 208 so that the notches 260 that receive the retention pins 256 extend parallel to or coincident with the central axes 258 of the cross apertures 252 when assembled. The notches 260 provide one example of a relief in the outer profile of the inner rod 116 for interaction with the retention pins 256, although other are contemplated, some of which are the subject of a latter portion of the present disclosure.

Figure 8:
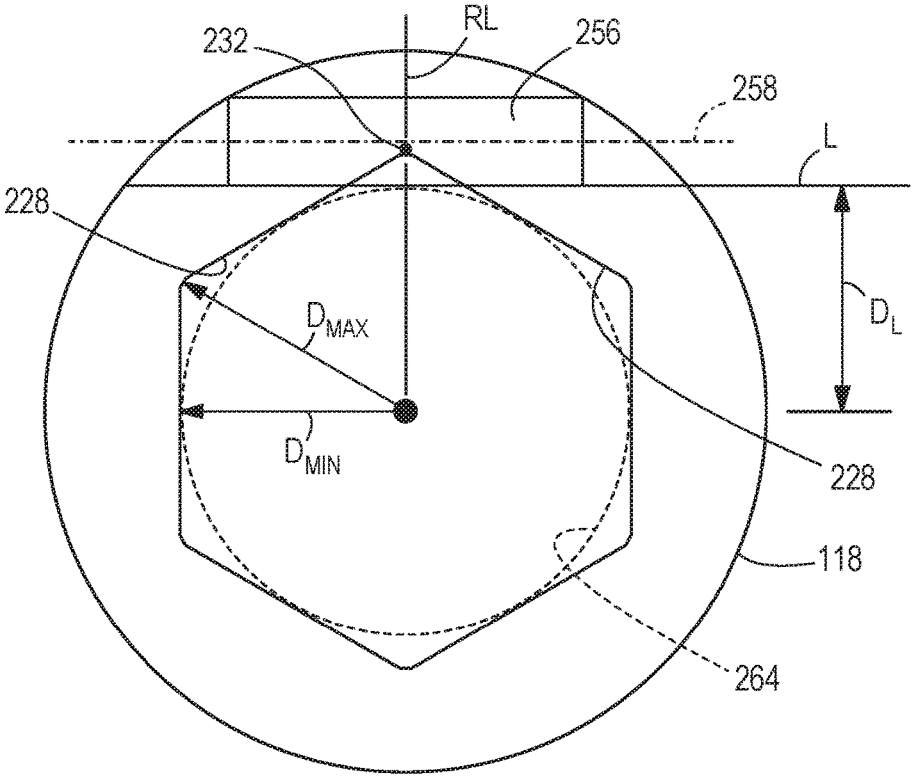
FIG. 8 schematically illustrates the coupler and inner rod of FIG. 5 having the hexagonal-shaped torque transmission interface, and the associated engagement between the retention pin and the inner rod.

In the illustrated embodiment, the depth of the notches 260 is such that the notches 260 do not cut into the inscribed circle 264 within the non-circular profile (e.g., the hexagonal profile) defined by the inner rod 116 (see FIG. 8). The inscribed circle 264 is the largest circle fitting within the non-circular profile, e.g., tangent to and not intersecting the flats 228. In other embodiments, the notches 260 may be of a depth that provides overlap between circumferentially-adjacent notches 260. In yet other embodiments, a single notch may extend to form a circumferential groove. In relation to the pins 256, the depth of the notches 116 into the corners 224 of the rod 116 can be, at the deepest point, between 0.25 and 0.6 times the diameter of the pins 256. While it is possible to form only a single notch 260 for each pin 256, forming a notch 260 at each corner 224 enables coupling of the rods 116 regardless of the angular orientation of one rod 116 relative to the adjacent, coupled rod 116.

The illustrated pins 256 are solid pins, however hollow roll pins can likewise be used. Additionally, different materials (e.g., bronze, plastic, etc.) for the pins 256 can be chosen to achieve the desired failure mode. Specifically, should axial or thrust forces between the coupler 118 and the rod 116 result in damage to the assembly, it is preferred that the pin 256 fail (e.g., pin shear) instead of allowing the pins to damage (e.g., shear off or shave off) the corners 224 of the rod 116.

By locating the cross apertures 252 and pins 256 in the enlarged portion 216, which in this embodiment is not a torque-transferring portion of the coupler 118, the number of stress risers in the main portion 212, which is a torque-transferring portion of the coupler 118, is reduced. Also, this locates the cross apertures 252 and pins 256 outside the region in which torsion and bending loads are being transferred. This increases fatigue life of the coupler 118 over designs that may include one or more retention features (e.g., pins) in the main, torque-transferring portion 212. Furthermore, by using only the small, distinct notches 260, the structural integrity of the rod 116 is increased as compared to arrangements requiring more material removal at the rod end.

There are various structural and geometrical relationships provided with the embodiment illustrated in FIGS. 5-7. First, it is noted that at least 25 percent of the outer peripheral surface 234 of the main portion 212 is spaced no more than a first distance Di from the longitudinal axis 208 (see FIG. 6). This may be a case in which stabilizers are provided about the outer peripheral surface 234. In some embodiments, at least 50 percent of the outer peripheral surface 234 of the main portion 212 is spaced no more than a first distance Di from the longitudinal axis 208. As illustrated, an entirety (i.e., 100 percent) of the outer peripheral surface 234 of the main portion 212 is spaced no more than the first distance Di from the longitudinal axis 208. For example, the outer peripheral surface 234 can be defined as a cylindrical surface having a radius equal to the first distance Di. The percentages above may be taken with respect to the totality of the outer peripheral surface 234 from one axial end to the other, or alternately may refer to the outer peripheral surface shape at a particular axial location such as a limited axial-length segment or a cross-section taken perpendicular to the longitudinal axis 208 at a single axial location. The first distance Di is chosen to maximize the flow of drilling fluid within the annular space between the inner and outer rods 116, 114 while ensuring a sufficient wall thickness of the coupler 118 at the torque-transmitting portion. Furthermore, at least 5 percent of the outer peripheral surface 248 of the enlarged portion 216 is spaced more than the first distance Di from the longitudinal axis 208. As illustrated, an entirety of the outer peripheral surface 248 of the enlarged portion 216 is spaced more than the first distance Di from the longitudinal axis 208. For example, the outer peripheral surface 248 can be defined as a cylindrical surface having a radius greater than the first distance Di. Once again, the fluid flow openings 244 are provided to accommodate the flow of drilling fluid. It can be stated that the distance Di is a distinguishing or delineating factor between a portion of the coupler 118 being the main portion 212 or the enlarged portion 216. As will be discussed with respect to other embodiments below, portions of the coupler that have some portion of the outer peripheral surface spaced more than the distance Di from the longitudinal axis 208 may be considered to be enlarged portions, even when adjacent portions of the outer peripheral surface in the same plane or circumferential segment are spaced no more than the distance Di from the longitudinal axis 208. As will be observed with those embodiments, the cross apertures 252 are located in such an enlarged portion.

Figure 17:
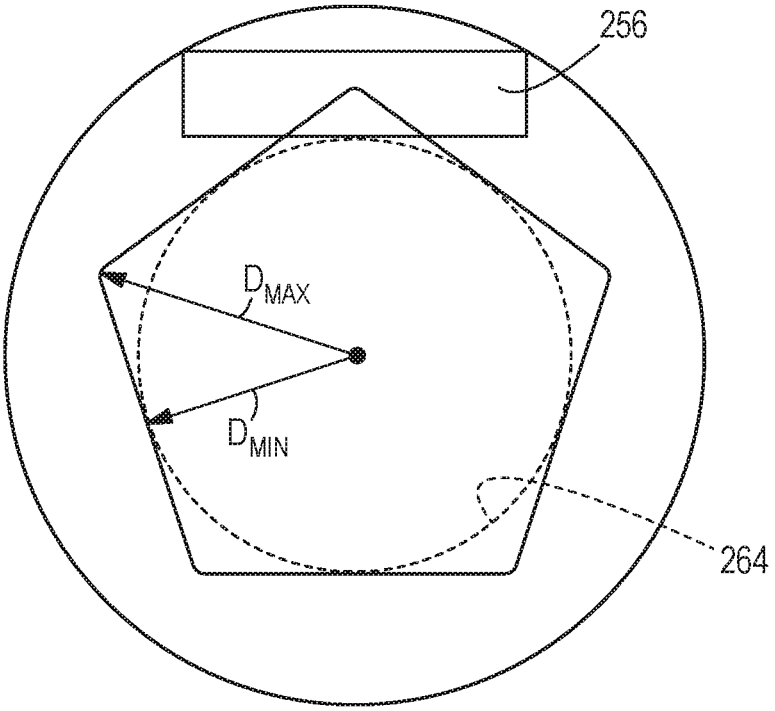
FIG. 17 schematically illustrates a coupler and inner rod having a pentagonal-shaped torque transmission interface, and the associated engagement between the retention pin and the inner rod.
Figure 18:
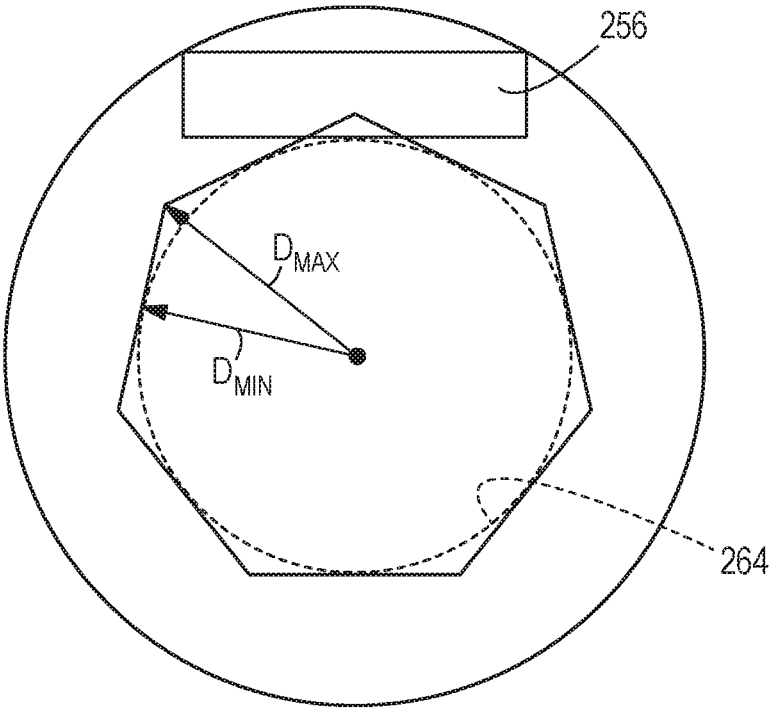
FIG. 18 schematically illustrates a coupler and inner rod having a heptagonal-shaped torque transmission interface, and the associated engagement between the retention pin and the inner rod.

Referring to FIGS. 7 and 8, another relationship exists between the cross apertures 252 and the inner bore 204. FIG. 7 is a cross section taken perpendicularly to the longitudinal axis 208 and through the enlarged portion 216 at the central axes 258 of the pins 256, and FIG. 8 is a schematic view similar to FIG. 7. The non-circular profile of the inner bore 204 includes a minimum distance $D_{min}$ measured from the longitudinal axis 208, and a maximum distance $D_{max}$ measured from the longitudinal axis 208. In the simple polygonal profile of the bore 204 as shown, the minimum distance $D_{min}$ is found at the center of each flat 228, and the maximum distance $D_{max}$ is found at each internal vertex 232. The cross aperture 252 is positioned relative to the bore 204 such that an imaginary line L extending parallel to the central axis 258, and positioned to extend along a radially-innermost surface of the cross aperture 252, is spaced from the longitudinal axis 208 by a distance $D_L$ that is equal to or greater than the minimum distance $D_{min}$ but less than the maximum distance $D_{max}$. In other words, the line L is on or radially outside the inscribed circle 264. This relationship stems from the size and depth of the notches 260, and the determination of the minimum amount of interference needed to adequately secure the coupler 118 on the rod 116 via the engagement or interference between each pin 256 and notch 260. With reference to FIGS. 17 and 18, it can be seen how this relationship can hold true regardless of the specific non-circular profile. One of skill in the art will understand how, according to this relationship, the amount of interference between each pin 256 and notch 260 will decrease as the number of sides of the polygonal profile increases. It is also noted that the line L, and thus the radially-innermost surface of the cross aperture 252, extends perpendicular to the line along which the maximum distance $D_{max}$ is measured. Stated differently, the line L extends perpendicular to a reference line RL from the longitudinal axis 208 through a vertex between a pair of adjacent flats 228. For a second cross aperture 252, there is also a second line L that extends perpendicular to a second reference line from the longitudinal axis 208 through a second vertex between a second pair of adjacent flats 228. In the case of diametrically-opposed cross apertures 252, the two reference lines RL are aligned, and the lines L along the radially-innermost surfaces of the two cross apertures 252 are parallel.

Figure 9:
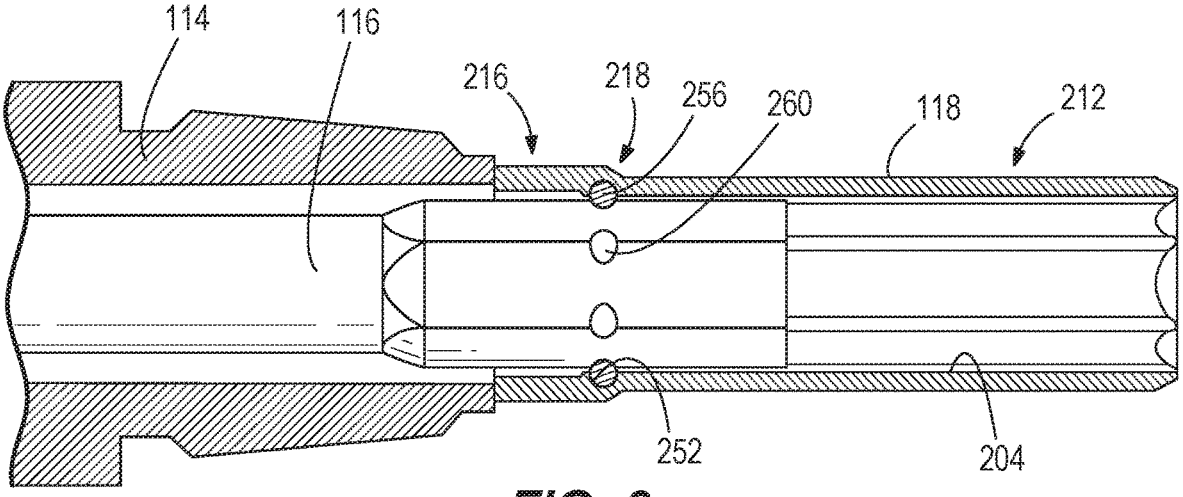
FIG. 9 illustrates an alternative embodiment of the coupler and inner rod with the retention pins located at a location on the coupler in which torque transmission can occur.

FIG. 9 illustrates an alternative embodiment similar to the embodiment shown in FIGS. 5-7, but in which the location of the cross apertures 252 and the notches 260 is moved relative to the coupler 118 and rod 116. Specifically, as shown in FIG. 9, the cross apertures 252 are moved axially toward the main portion 212 (to the right in FIG. 9), and the notches 260 are moved a corresponding distance toward the end of the rod 116. In the illustrated location, the cross apertures 252 position the pins 256 into the torque-transmitting portion of the coupler 118. The pins 256 thereby intersect or engage the inner rod 116 at an axial location where the inner profile of the coupler 118 matches the outer profile of the rod 116 so that the pins 256 are subjected more directly to shear and so that a bending load on the pins 256 is reduced or eliminated. While the apertures 252 are illustrated as being in the transition portion 218, this location in the transition portion includes the non-circular, torque-transmitting profile of the inner bore 204.

Figure 10:
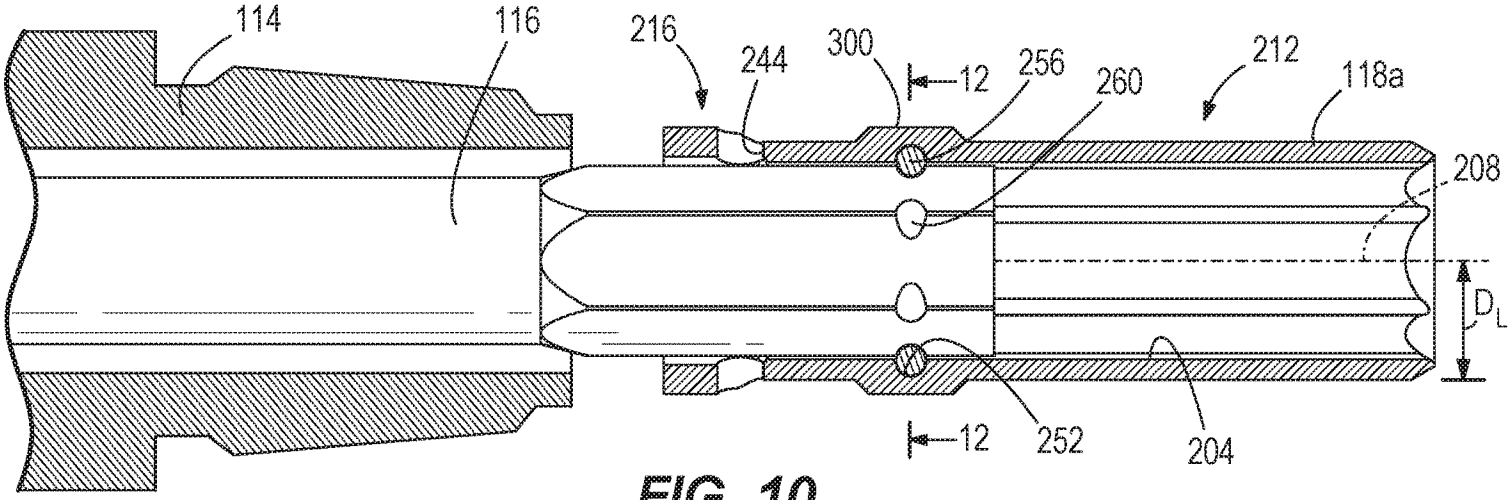
FIG. 10 illustrates yet another alternative embodiment of the coupler and inner rod with the retention pins located further along the coupler such that the coupler includes one or more projections or lobes to house the retention pins.
Figure 11:
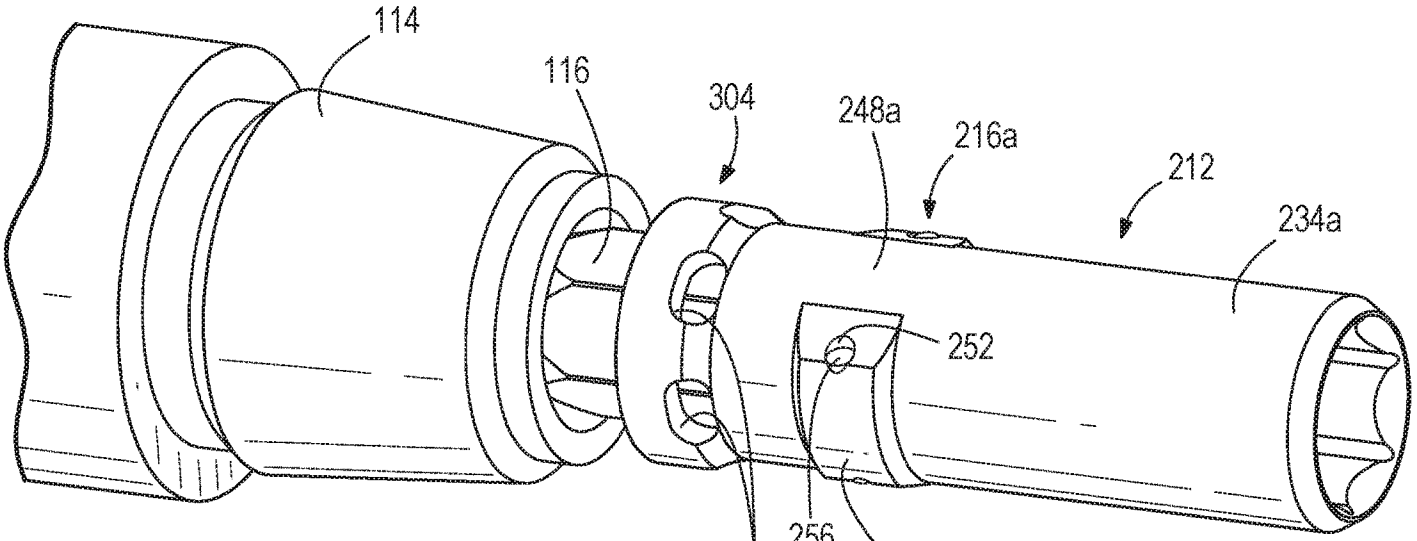
FIG. 11 is a perspective view of the embodiment of FIG. 10.
Figure 12:
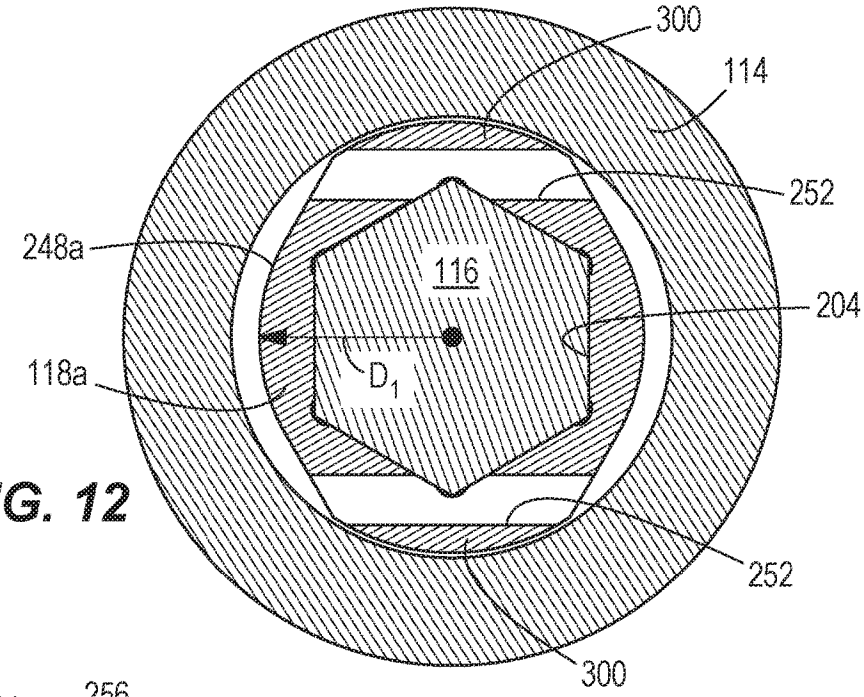
FIG. 12 is a section view illustrating the engagement between the retention pins in the coupler and the notches in the inner rod for the embodiment of FIGS. 10 and 11.

FIGS. 10-12 illustrate yet another embodiment in which the location of the cross apertures 252 and the notches 260 is moved even further relative to the coupler 118 and rod 116 than in FIG. 9. In this embodiment, the coupler **118*a* is modified to include lobes or projections 300 formed in what was originally the main portion 212 in relation to the coupler 118. These lobes 300 provide additional material to receive/support the cross apertures 252, and thus render the portion of the coupler 118*a* containing the lobes 300 to be considered an enlarged portion 216*a*. As seen in FIG. 12, the lobes 300 give the outer peripheral surface of the coupler 118*a* a generally elliptical shape in a cross section taken through the lobes 300 and perpendicular to the longitudinal axis 208. Of course, other geometries can be used for the lobes, with the configuration accounting for the added material needed for the cross apertures 252 as well as the desire to maximize the fluid flow in the annular space between the inner and outer rod 116, 114. The coupler 118*a* still includes an enlarged portion 304 at one distal end for engaging the distal end of the outer rod 114. As illustrated in FIG. 11, that enlarged portion 304 includes four fluid flow openings 244**.

While the lobes 300 exceed the distance Di from the longitudinal axis 208, the remainder of the outer peripheral surface in the axial section containing the lobes 300 is no more than the distance Di from the longitudinal axis 208 so that there will be a sufficient flow of drilling fluid. In this illustrated embodiment, 5 percent or more of the outer peripheral surface **248*a* of the enlarged portion 216*a* is spaced more than the first distance Di from the longitudinal axis 208, and more particularly this amount may be between 20 percent and 40 percent. The lobes 300 extend over approximately one-third of the circumference of the enlarged portion 216*a*, such that about 33 percent of the outer peripheral surface 248*a* of the enlarged portion 216*a* is spaced more than the first distance Di from the longitudinal axis 208. The remaining 67 percent or two-thirds of the outer peripheral surface 248*a* is no more than the first distance Di from the longitudinal axis 208 so that drilling fluid can still flow freely in the axial direction past the lobes 300. Generally, the part of the outer peripheral surface 248*a* of the enlarged portion 216*a* that is spaced more than the first distance Di from the longitudinal axis 208 should be kept as small as possible, and may be less than 33 percent, or less than 20 percent in some embodiments. As best illustrated in FIG. 11, this smaller-diameter portion of the outer peripheral surface 248*a* of the enlarged portion 216*a* blends or flows smoothly with the outer peripheral surfaces 234*a* of the main portions 212*a* on either axial side of the enlarged portion 216*a*. The same relationship described above regarding the distance to the imaginary line L extending parallel to the central axis 258, and positioned at a radially-innermost surface of the cross aperture 252**, also holds true for this embodiment.

Figure 13:
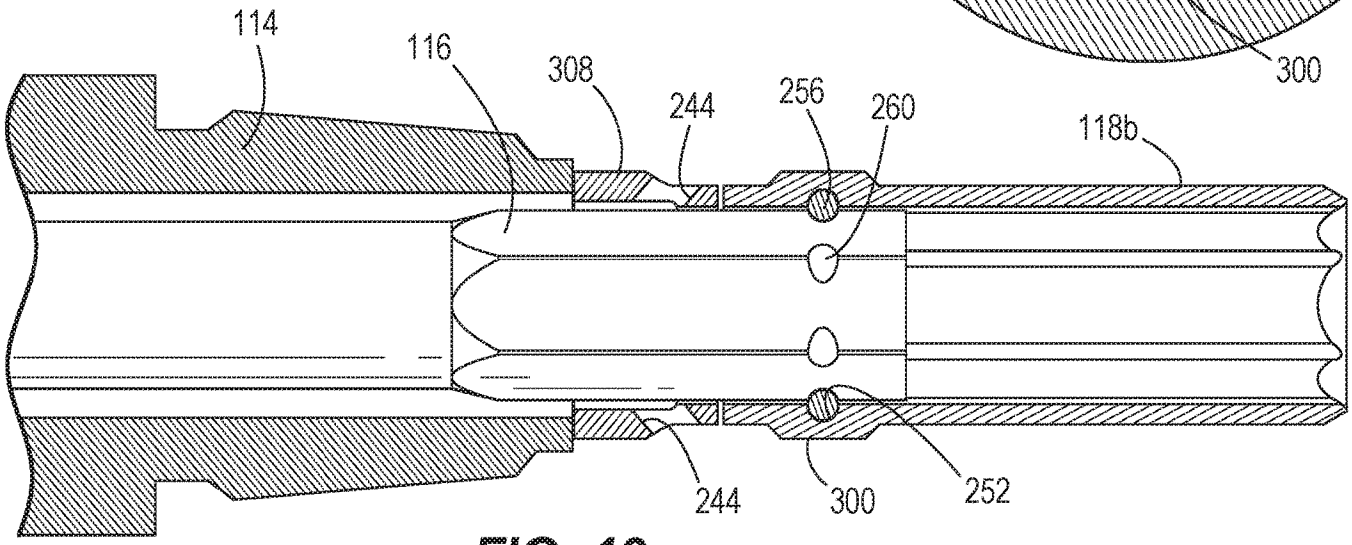
FIG. 13 illustrates yet another embodiment, similar to that of FIG. 10, but in which a replaceable wear ring is provided in addition to the coupler.

FIG. 13 illustrates another embodiment that is like the embodiment shown in FIGS. 10-12, except that instead of having the integrated enlarged portion 304 of the coupler **118*a*, a separate wear ring 308 is provided. The coupler 118*b* has a shorter axial length to accommodate the wear ring 308, but is otherwise the same as the coupler 118*a* up to the enlarged portion 304. The separate wear ring 308 provides a separate replaceable part that can be exchanged when worn, without requiring replacement of the coupler 118*b*. As illustrated, the wear ring 308 has an inner bore with a portion that is torque-transmitting (e.g., non-circular profile) and a portion that is not (e.g., cylindrical profile). The wear ring 308 includes one or more fluid flow openings 244**.

Figure 15:
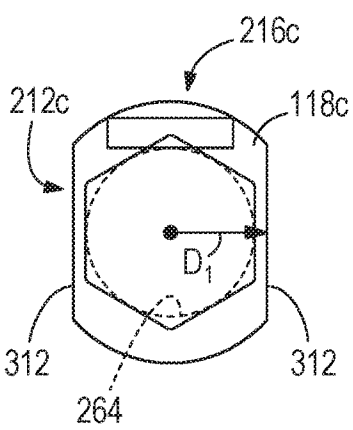
FIG. 15 is a section view of the arrangement of FIG. 14 taken through a retention pin.
Figure 14:
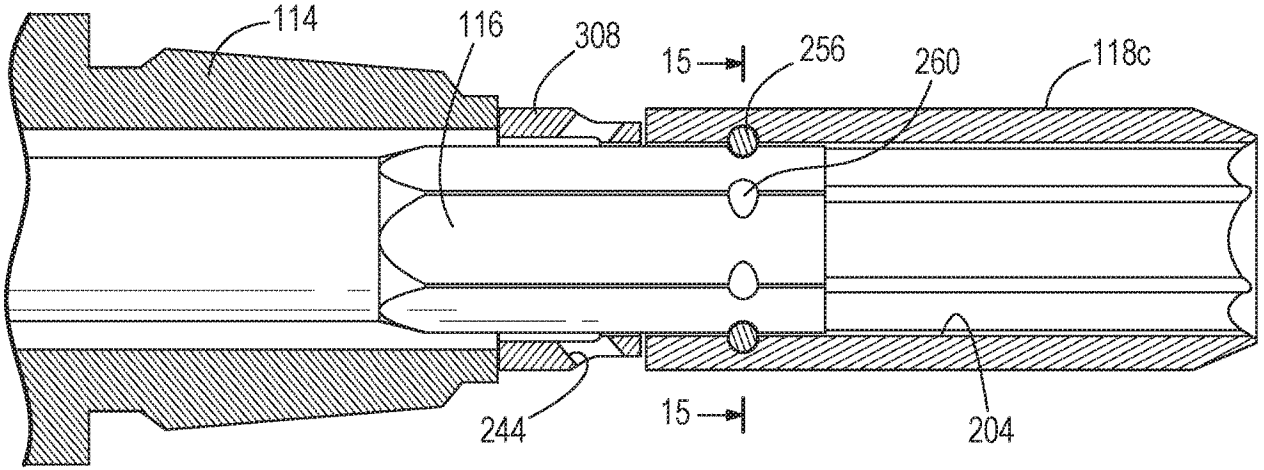
FIG. 14 illustrates yet another embodiment of a rod coupler arrangement.

FIGS. 14 and 15 illustrate yet another embodiment that is somewhat like the embodiment of FIG. 13 except that the outer peripheral surface of the coupler 118*c* is not generally circular/cylindrical, but instead includes oppositely facing flats 312 extending the length of the coupler 118*c*. With this design, the distance Di from the longitudinal axis 208 could be measured at the flats 312, which could be considered as the main portion 212*c* of the coupler 118*c*, and the two portions of the coupler 118*c* housing the pins 256 would be considered the enlarged portions 216*c*. Unlike the prior embodiments, in which the main portions and enlarged portions were axially spaced from one another and encompassed the complete circumferential segment about the longitudinal axis 208, in this embodiment, the main portions 212*c* and the enlarged portions 216*c* are circumferentially spaced from one another and can each extend the entire axial length of the coupler 118*c*. The flats 312 would provide the appropriate fluid flow area. In some embodiments the enlarged portions 216*c* may not extend the entire axial length of the coupler 118*c* to provide for additional fluid flow area.

Figure 16:
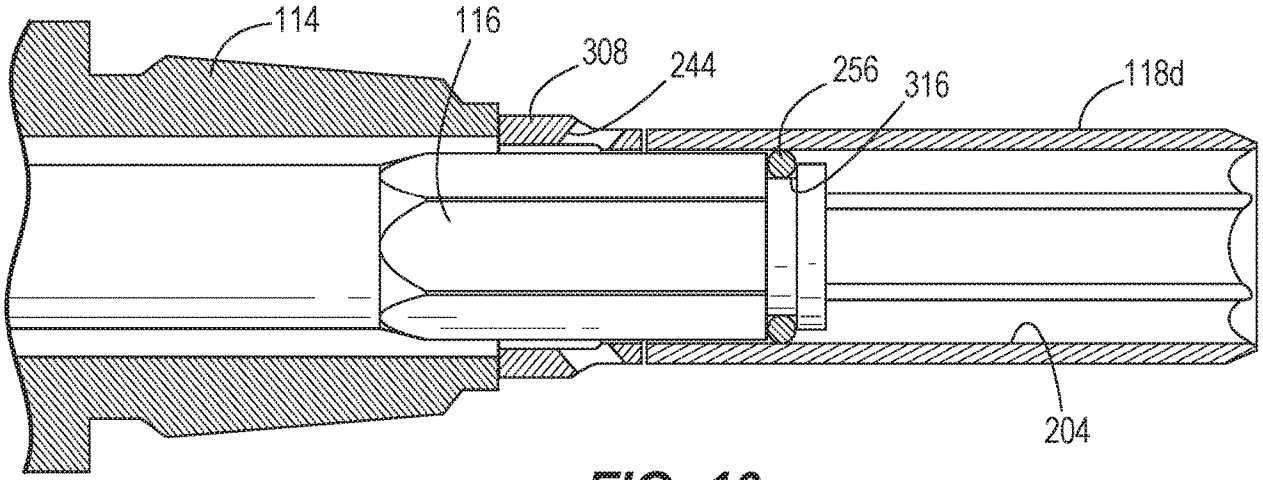
FIG. 16 illustrates another embodiment of a rod coupler arrangement.

FIG. 16 illustrates another embodiment in which the coupler 118*d* does not include any enlarged portion at all. Rather, the coupler 118*d* consists only of the main portion 212, which is cylindrical in the illustrated construction. To accommodate the retention pins 256, the rod 116 is turned down at one end to include a relief in the form of a groove or channel 316 that receives the pins 256. In this embodiment, the entire width (e.g., diameter dimension) of the pin 256 passes through the inner bore 204, at least within a central portion of the pin's length. A coupler similar to this arrangement is described in U.S. Patent Application Publication No. 2018/0313169A1, published on Nov. 1, 2018.

Figure 19:
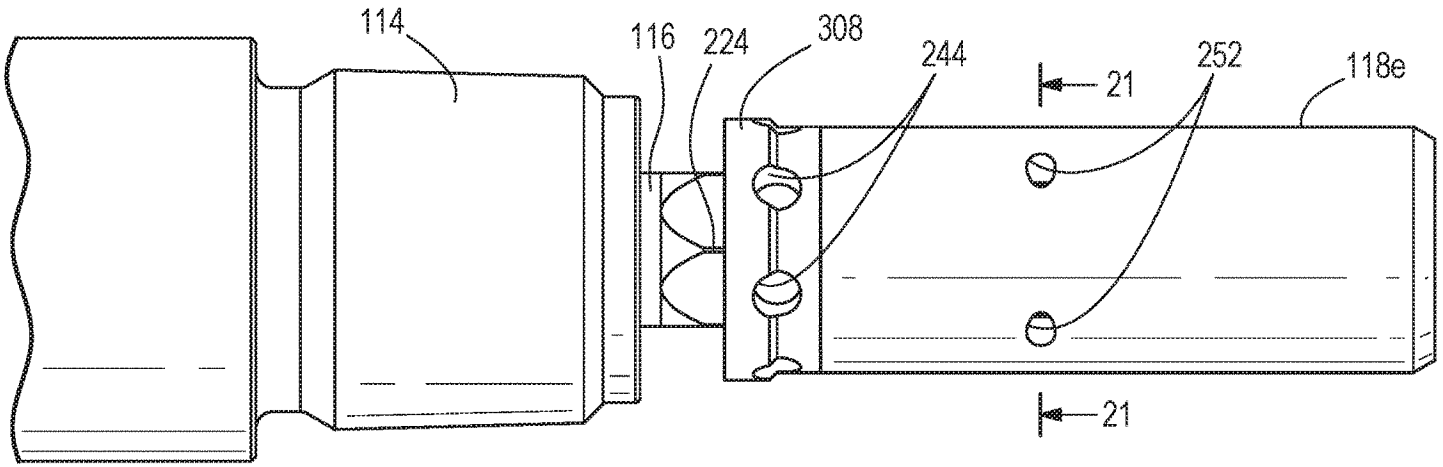
FIG. 19 illustrates yet another alternative embodiment of the coupler having no projections or lobes to house the retention pins. A replaceable wear ring is provided in addition to the coupler.
Figure 20:
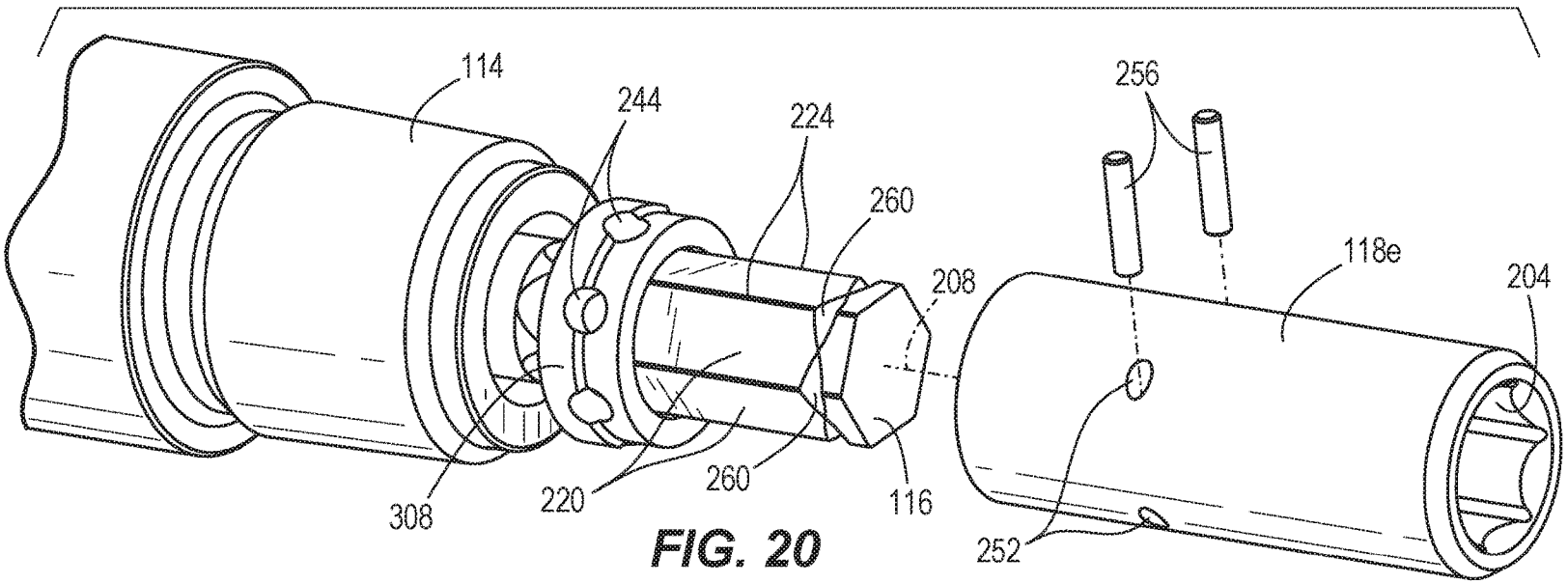
FIG. 20 is a perspective assembly view of the embodiment of FIG. 19 showing the coupler and retention pins exploded from the inner rod.
Figure 21:
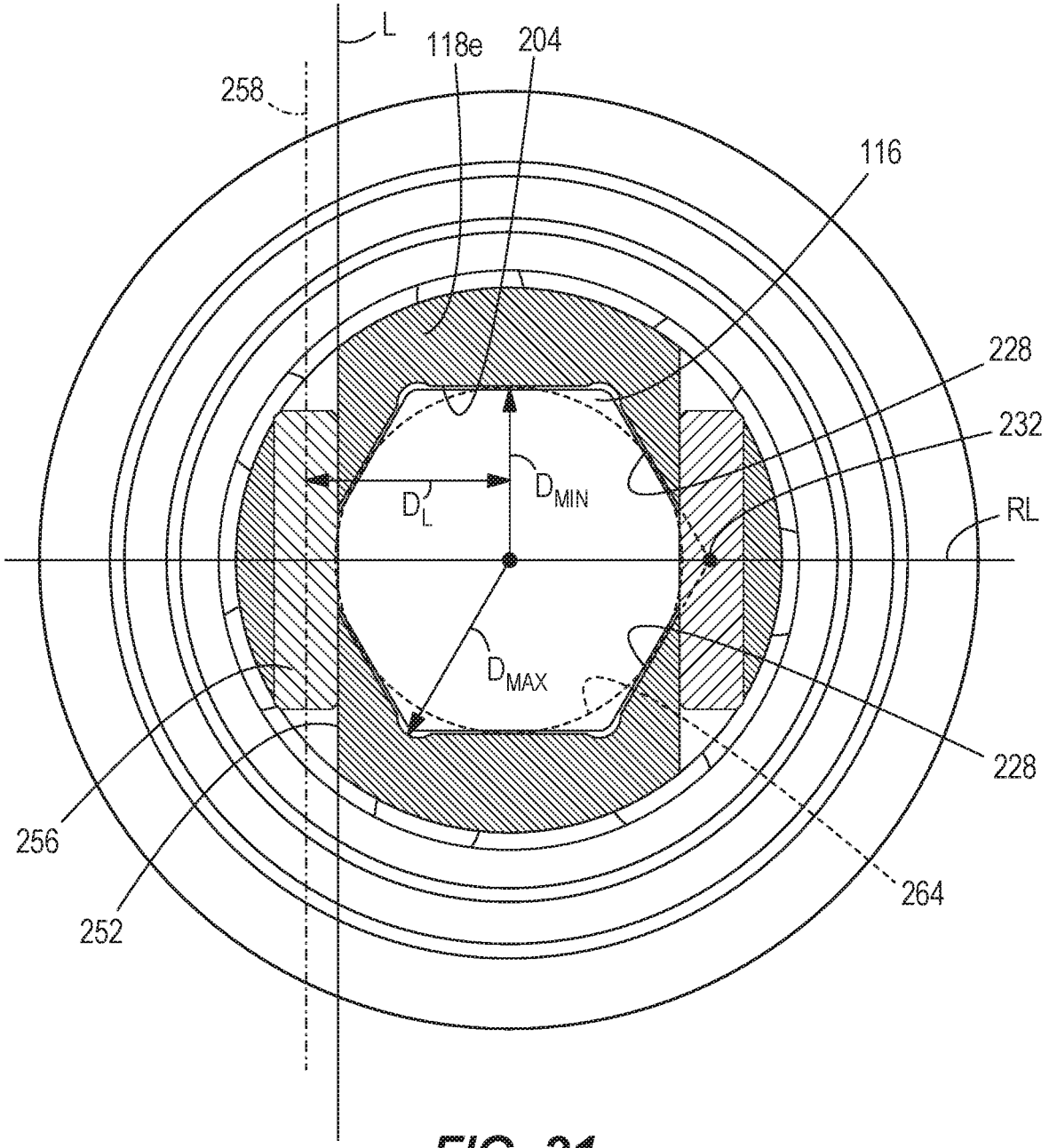
FIG. 21 is a section view taken along line 21-21 of FIG. 19, through the cross apertures of the coupler.

In the embodiment of FIGS. 19-21, the coupler 118*e* is similar to that of FIG. 16, having no projections or lobes to house the retention pins 256. Rather, the entire coupler 118*e* consists only of the (e.g., cylindrical) main portion 212 in which the cross apertures 252 are provided. A replaceable wear ring 308 is provided in addition to the coupler 118*e*. Rather than having the large, full groove or channel 316 in the inner rod 116, the inner rod 116 of FIGS. 19-21 includes smaller individual notches 260 at one or more circumferential positions. The notch 260 is formed across the edge or corner 224 formed between a pair of adjacent flats 220. Similar notches 260 may be formed at each corner 224. As shown in FIG. 21, the relationship between the inner bore 204 and the cross aperture(s) 252 can be similar to that described above with respect to FIGS. 7 and 8. In particular, the central axis 258 of the cross aperture 252 is perpendicular to and offset from the longitudinal axis 208, and a radially-innermost portion of the cross aperture 252 extends perpendicular to a reference line RL extending from the longitudinal axis 208 to the vertex 232 between adjacent flats 228. Further, the non-circular profile of the inner bore 204 has a first portion defining a minimum distance $D_{min}$ from the longitudinal axis 208, and a second portion defining a maximum distance $D_{max}$ from the longitudinal axis 208, and the radially-innermost portion of each cross aperture 252 is spaced from the longitudinal axis 208 by a distance that is equal to or greater than the minimum distance $D_{min}$ and less than the maximum distance $D_{max}$.

Figure 22:
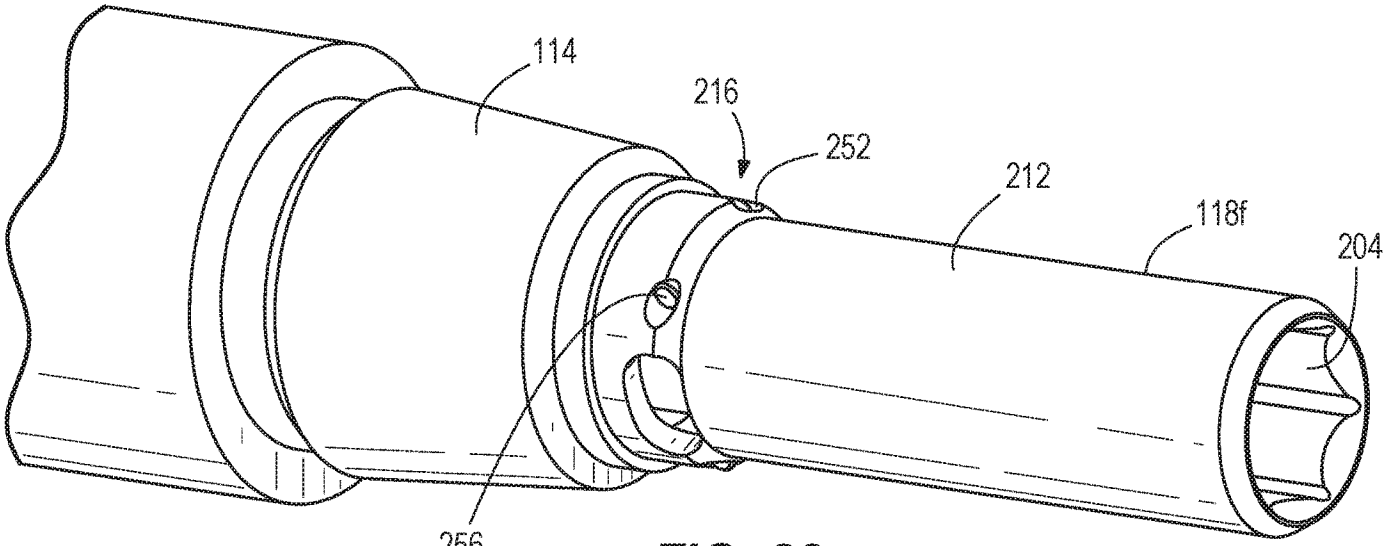
FIG. 22 is a perspective view of yet another alternative embodiment of the coupler having an enlarged portion.
Figure 23:
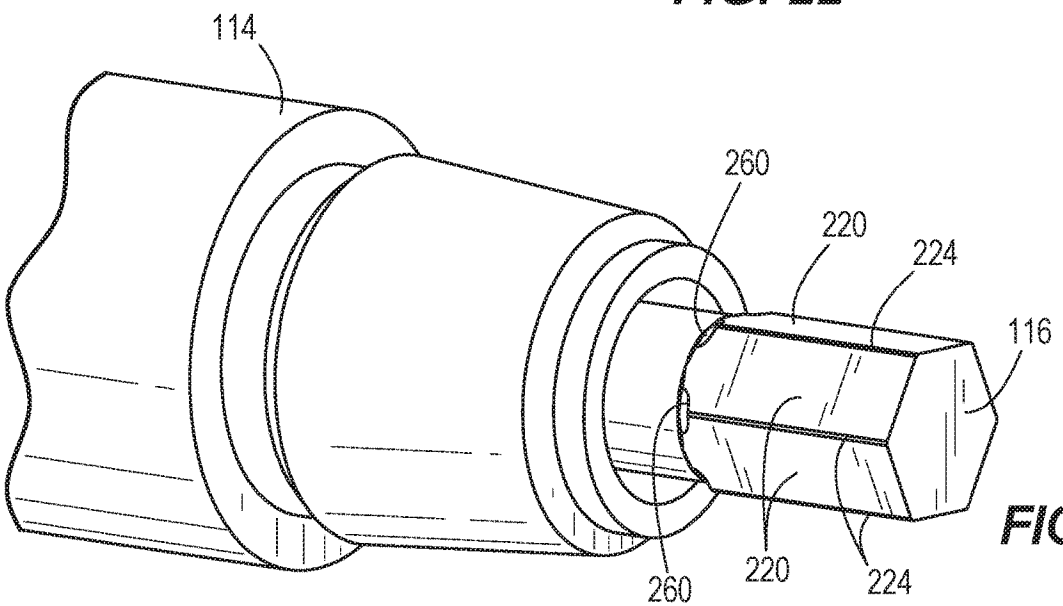
FIG. 23 is a perspective view of the embodiment of FIG. 22 in which the coupler and retention pins are removed to illustrate the configuration of the inner drill rod.

In the embodiment of FIGS. 22 and 23, the coupler 118*f* includes one or more cross apertures 252 positioned within the enlarged portion 216. Thus, the cross apertures 252 and the corresponding retention pins 256 are located adjacent an inboard end of the coupler 118*f*, opposite a distal end thereof (inboard and distal taken with respect to the inner rod 116 that is axially retained by the coupler 118*f* and not the additional coupled inner rod, which is not shown). The cross apertures 252 and retention pins 256 are located at a common axial position with one or more fluid flow openings 244. Furthermore, it is shown in FIG. 23 that the notches 260 in the inner rod 116 are located at an axial position of a transition between a first section (e.g., distal end section) having the non-circular outer profile with the flats 220 and the edges or corners 224, and a second section (e.g., proximal or further inboard section) having a different outer profile. The outer profile of the second section can be circular such that the second section is a cylindrical section of the inner rod. Other aspects of the arrangement of the cross apertures 252 with respect to the inner bore 204 can follow with the preceding description. Due to the axial placement of the notches 260, each notch borders an edge or corner 224 only on one axial side rather than on both axial sides as shown in FIGS. 5, 9, 10, 13, 14, and 20. This positioning can also be adopted by an inner rod 116 having a different type of retention pin relief, such as that shown in FIG. 16. This generally results in an axial reversal of the configuration shown in FIG. 16. The groove or channel 316 of FIG. 16 is bordered on the distal end by a circular or cylindrical section and bordered only to the inboard axial side by the non-circular outer profile having the flats 220 and the edges or corners 224.

Various features and aspects of the invention are set forth in the following claims.

What is claimed is:

1. A coupler for a drill rod, the coupler comprising:

a body defining an inner bore extending along a longitudinal axis, at least a portion of the inner bore defining a non-circular profile having a plurality of flats including a first pair of adjacent flats defining a vertex therebetween, and a cross aperture having a central axis that is perpendicular to and offset from the longitudinal axis, wherein a radially-innermost portion of the cross aperture extends perpendicular to a reference line extending from the longitudinal axis to the vertex.

2. The coupler of claim 1, wherein the plurality of flats of the non-circular profile comprises four or more flats distributed about the longitudinal axis in a uniform pattern.

3. The coupler of claim 1, wherein the plurality of flats of the non-circular profile comprises six equal-length flats configured to receive a hex-shaped drill rod.

4. The coupler of claim 1, wherein the non-circular profile has a first portion defining a minimum distance from the longitudinal axis, and a second portion defining a maximum distance from the longitudinal axis, and wherein the radially-innermost portion of the cross aperture defines a second reference line, and a distance measured perpendicular to the second reference line from the second reference line to the longitudinal axis is equal to or greater than the minimum distance and less than the maximum distance.

5. The coupler of claim 1, wherein the body includes a) a main portion having an outer peripheral surface of which at least 25 percent is spaced no more than a first distance from the longitudinal axis; and b) an enlarged portion at an axial position different from the main portion, wherein at least 5 percent of an outer peripheral surface of the enlarged portion is spaced more than the first distance from the longitudinal axis, and wherein the cross aperture is positioned in the enlarged portion of the body.

6. The coupler of claim 5, wherein the enlarged portion of the body includes one or more fluid flow openings formed to extend between the inner bore and the outer peripheral surface of the enlarged portion.

7. The coupler of claim 5, wherein an entirety of the outer peripheral surface of the main portion is spaced no more than the first distance from the longitudinal axis.

8. The coupler of claim 7, wherein the outer peripheral surface is a cylindrical surface having a radius equal to the first distance.

9. The coupler of claim 1, wherein the plurality of flats further includes a second pair of adjacent flats defining a second vertex therebetween, the coupler further comprising a second cross aperture having a central axis that is perpendicular to and offset from the longitudinal axis, wherein a radially-innermost portion of the second cross aperture extends perpendicular to a second reference line extending from the longitudinal axis to the second vertex.

10. The coupler of claim 9, wherein the central axes of the cross aperture and the second cross aperture are parallel and equidistant from the longitudinal axis.

11. The coupler of claim 1, wherein the body defines a cylindrical-shaped outer peripheral surface extending throughout a majority axial length thereof, and wherein the cross aperture is located at an axial position within the majority axial length having the cylindrical-shaped outer peripheral surface.

12. The coupler of claim 1, wherein the body defines an outer peripheral surface, and wherein, at the axial position of the cross aperture, the outer peripheral surface is non-circular and includes a lobe through which the cross aperture is formed.

13. A coupling system for a dual rod drilling system, the coupling system comprising:

the coupler of claim 1;

an inner drill rod comprising:

a torque-transmitting section having a non-circular outer profile configured to mate with the non-circular profile of the inner bore of the coupler; and a relief formed in the non-circular outer profile; and a pin positioned within the cross aperture of the coupler and at least partially within the relief of the inner drill rod to secure the inner drill rod relative to the coupler in a direction of the longitudinal axis.

14. The coupling system of claim 13, wherein the relief is a notch extending only through a corner formed between a pair of adjacent surfaces of the non-circular outer profile.

15. A coupler for a drill rod, the coupler comprising:

a body defining an inner bore extending along a longitudinal axis, at least a portion of the inner bore defining a non-circular profile, and a cross aperture having a central axis that is perpendicular to and offset from the longitudinal axis, wherein the body defines an outer peripheral surface, and wherein, at the axial position of the cross aperture, the outer peripheral surface is non-circular and includes a lobe through which the cross aperture is formed.

16. The coupler of claim 15, wherein the cross aperture is a first cross aperture, the coupler further comprising a second cross aperture having a central axis that is perpendicular to and offset from the longitudinal axis at the axial position of the first cross aperture, and wherein the outer peripheral surface includes a second lobe through which the second cross aperture is formed.

17. The coupler of claim 16, wherein the first cross aperture and the second cross aperture are diametrically-opposed from one another about the longitudinal axis such that the central axes of the first and second cross apertures are parallel.

18. The coupler of claim 15, wherein, at the axial position of the cross aperture, between 20 percent and 40 percent of the outer peripheral surface is spaced more than a first distance from the longitudinal axis, and the remainder of the outer peripheral surface is spaced no more than the first distance from the longitudinal axis so that drilling fluid can flow freely in the axial direction past the lobe.

19. The coupler of claim 15, wherein, at the axial position of the cross aperture, one-third of the outer peripheral surface is spaced more than a first distance from the longitudinal axis, and the remaining two-thirds of the outer peripheral surface is spaced no more than the first distance from the longitudinal axis so that drilling fluid can flow freely in the axial direction past the lobe.

20. The coupler of claim 15, wherein the non-circular profile has a first portion defining a minimum distance from the longitudinal axis, and a second portion defining a maximum distance from the longitudinal axis, and wherein the radially-innermost portion of the cross aperture defines a second reference line, and a distance measured perpendicular to the second reference line from the second reference line to the longitudinal axis is equal to or greater than the minimum distance and less than the maximum distance.

21. The coupler of claim 15, wherein the non-circular profile includes four or more flats distributed about the longitudinal axis in a uniform pattern, the flats including a first pair of adjacent flats defining a vertex therebetween, and wherein a radially-innermost portion of the cross aperture extends perpendicular to a reference line extending from the longitudinal axis to the vertex.

22. The coupler of claim 15, wherein the non-circular profile includes six equal-length flats configured to receive a hex-shaped drill rod.

23. The coupler of claim 15, wherein the body is provided with an enlarged portion at an axial position spaced from the axial position of the cross aperture, the enlarged portion having one or more fluid flow openings formed to extend between the inner bore and the outer peripheral surface.

24. The coupler of claim 15, wherein the outer peripheral surface of the body is cylindrical with the exception of the axial position of the cross aperture.

25. A coupling system for a dual rod drilling system, the coupling system comprising:

the coupler of claim 15;

an inner drill rod comprising:

a torque-transmitting section having a non-circular outer profile configured to mate with the non-circular profile of the inner bore of the coupler; and a relief formed in the non-circular outer profile; and a pin positioned within the cross aperture of the coupler and at least partially within the relief of the inner drill rod to secure the inner drill rod relative to the coupler in a direction of the longitudinal axis.

26. The coupling system of claim 25, wherein the relief is a notch extending only through a corner formed between a pair of adjacent surfaces of the non-circular outer profile.

* * * * *